US005244204A

United States Patent [19]

Zeller

[11] Patent Number: 5,244,204

[45] Date of Patent: Sep. 14, 1993

[54] HOLDER FOR A GOLF BALL POSITION MARKER

[76] Inventor: Henry O. Zeller, P.O. Box 13436, Rochester, N.Y. 14613

[21] Appl. No.: 980,351

[22] Filed: Nov. 23, 1992

[51] Int. Cl.[5] ..... A63B 57/00; A63B 53/00

[52] U.S. Cl. ..... 273/32 A; 273/162 D; 224/918; 206/0.82

[58] Field of Search ..... 273/162 D, 162 F, 32 A, 273/32 B; 224/918; 206/0.82, 0.83, 0.84

[56] References Cited

U.S. PATENT DOCUMENTS

| | | | |
|---|---|---|---|
| Re. 31,264 | 6/1983 | Holmes | 206/0.82 |
| 2,261,959 | 11/1941 | Buttikofer | 273/32 A |
| 3,339,300 | 9/1967 | Bury | 273/32 A |
| 3,977,674 | 8/1976 | Zeller | 273/32 A |

*Primary Examiner*—George J. Marlo
*Attorney, Agent, or Firm*—Robert J. Bird

[57] ABSTRACT

A holder for a golf ball position marker includes a band to fit on a putter shaft, and a crown on the band to hold the marker. The crown includes opposed pairs of spaced wall segments forming a segmented circulra retaining wall partially surrounding a central cavity. Vertical snap fingers in the spaces between the pairs of wall segments oppose each other across the central cavity. The arcuate walls and the snap fingers together releasably hold the marker in place. The wall segments are higher than, and extend radially outward of, the snap fingers. Bridges connect the pairs of wall segments, over and outward of the snap fingers to protect the snap fingers from unintended opening and breakage.

1 Claim, 1 Drawing Sheet

HOLDER FOR A GOLF BALL POSITION MARKER

FIELD OF THE INVENTION

This invention is a convenient holder for a coin used as golf ball position marker.

BACKGROUND INFORMATION

In the game of golf, when players have reached the green, it is customary to remove any ball which is likely to be in the way of the putts of others, and to mark the spot of that ball with a marker, such as a ten cent piece. There are various known convenience holders for these markers.

The relevant prior art is my own U.S. Pat. No. 3,977,674 issued Dec. 11, 1974, and entitled Holder For A Golf Ball Marking Plate. The holder disclosed in that patent may be likened to a finger ring with a band and a crown. The band of the ring fits on the shaft of a putter, below the grip. The crown of the ring is a circular cavity, with wall segments extending upward from it on each side. There are two such wall segments on each side of the cavity, separated by a space, and a vertical snap finger within the space. Thus, two vertical snap fingers diametrically oppose each other across the circular cavity. A golf ball position marker, such as a ten cent piece, or dime, snaps into the cavity between the opposed snap fingers. The resilient snap fingers press against opposite edges of the dime to hold it securely in place. The dime is removable from this receptacle by thumbnail or fingernail.

That device of my earlier patent has not been entirely satisfactory. The wall segments, and the snap fingers between them, are prominant and protruding parts of the device. In moving the putter into and out of a golf bag, the leather or vinyl material of the bag, because it is pliable, sometimes intrudes into the device, interfering with or breaking the snap fingers.

The object of this invention is to improve my device by provision for protecting the snap fingers against interference or breakage from intrusion.

SUMMARY OF THE INVENTION

The present invention is a holder for a golf ball position marker. It includes a band to fit on a putter shaft, and a crown on the band to hold a dime. The crown includes opposed pairs of spaced wall segments forming a segmented circular retaining wall partially surrounding a central cavity. Vertical snap fingers in the spaces between the pairs of wall segments oppose each other across the central cavity. The arcuate walls and the snap fingers together releasably hold a dime in place. The wall segments are higher than, and extend radially outward of, the snap fingers. Bridges connect the pairs of wall segments, over and outward of the snap fingers to protect the snap fingers from unintended opening and breakage.

DRAWING

DESCRIPTION

Figure 1:
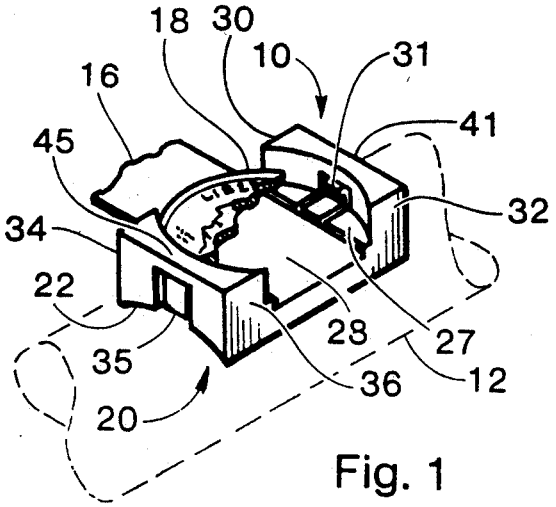
FIG. 1 is a perspective view of my marker holder.

With reference to the drawing, the marker holder 10 is shown mounted on the shaft 12 of a putter. The holder 10 is in the general form of a finger ring, with a band 16 to fit on the putter shaft, and a crown 20 to hold a marker.

The crown 20 includes a curved bottom 22 to conform to the shape of the club shaft 12, and a top 24. The top 24 includes a central cavity 26 which is essentially circular and is partially surrounded by upraised arcuate wall segments 30, 32, 34, 36 forming a retaining wall around the central cavity 26. The cavity 26 includes a bottom surface 28, and steps 27 defining a plane above the bottom surface. A thin band 16 of Mylar tape wrapped around the bottom surface 28 and around the putter shaft 12 secures the device to the putter. The steps 27 are above the band 16 enough so that the band 16 does not intrude into the plane formed by the steps 27.

Figure 4:
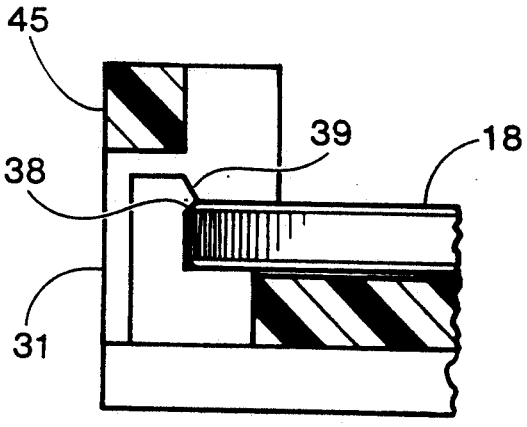
FIG. 4 is an enlarged detail view of a snap finger.

A vertical flexible finger or snap finger 31 stands in the space between the arcuate wall segments 30, 32 and a similar vertical snap finger 35 stands in the space between the arcuate wall segments 34, 36. The vertical snap fingers 31, 35 diametrically oppose each other across the central cavity 26. The snap fingers 31, 35 (FIG. 4) each include a lip 38 extending inward from the top of the finger, and an inward sloping top surface 39.

A golf ball position marker 18, such as a ten cent piece snaps into the central cavity 26 between opposed snap fingers 31, 35, and onto the steps 27. The sloping top surfaces 39 facilitate placement of the dime into the central cavity. The snap fingers 31, 35 press against opposite edges of the dime and their lips 38 engage it, holding it securely in place. The dime is removable from this receptacle by thumbnail or fingernail.

In my earlier Pat. No. 3,977,674, the arcuate wall segments and the snap fingers were of the same height and thickness, equally prominant and protruding Thus, the snap fingers were generally exposed to the same contacts and impacts as were the wall segments.

Figure 2:
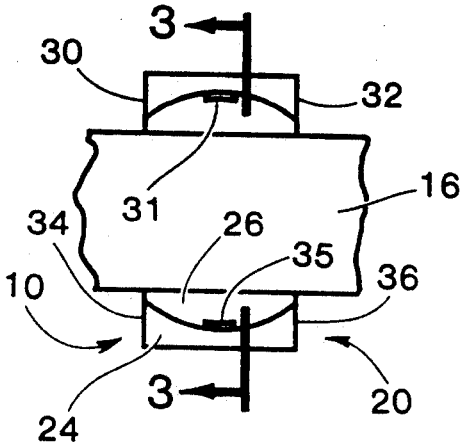
FIG. 2 is a top view of the marker holder of FIG. 1.
Figure 3:
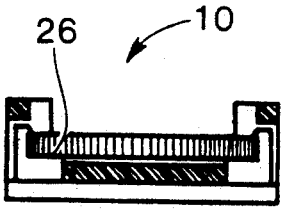
FIG. 3 is a sectional view on the plane 3—3 of FIG. 2.

Reference is now back to FIGS. 1, 2, and 3. The wall segments 30, 32, 34, 36 are higher than the snap fingers, as best seen in FIG. 1. They are also thicker, extending farther out radially, as best seen in FIG. 2.

A bridge 41 connects the wall segments 30 and 32, extending over and outward of the snap finger 31. Similarly at bridge 45 connects the wall segments 34 and 36, extending over and outward of the snap finger 35.

The bridges 41 and 45 effectively protect the snap fingers 31 and 35 from impact, and thus from accidental opening or breakage. Furthermore, the bridges 41 and 45 do not interfere with the resilient action of the snap fingers required for their normal use and function. Also, the bridges do not inhibit the use of the device. Insertion and removal of the dime into and out of the cavity are not effected.

The foregoing description of a preferred embodiment of this invention, including any dimensions, angles, or proportions, is intended as illustrative. The concept and scope of the invention are limited only by the following claims and equivalents thereof.

What is claimed is:

1. A holder for a golf ball position marker, said holder including a band to encircle a supporting shaft, and a crown on said band, said crown including:

a plurality of spaced arcuate wall segments forming a segmented circular retaining wall partially surrounding a central cavity;

a first vertical snap finger in the space between a first pair of said wall segments on one side of said central cavity, and a second opposed vertical snap finger in the space between a second pair of said wall segments on the opposite side of said central cavity;

said wall segments extending higher than said snap fingers, and radially outward of said snap fingers;

a first bridge connecting the wall segments of said first pair, over and outward of said first snap finger, and a second bridge connecting the wall segments of said second pair, over and outward of said second snap finger;

said bridges protecting said snap fingers from unintended opening and breakage.

* * * * *